US006196856B1

(12) United States Patent
De Villeroche

(10) Patent No.: US 6,196,856 B1
(45) Date of Patent: Mar. 6, 2001

(54) FLOATING CONNECTOR ASSEMBLY

(75) Inventor: Francois Jodon De Villeroche, La Celle Saint Cloud (FR)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/334,258

(22) Filed: Jun. 16, 1999

(30) Foreign Application Priority Data

Jun. 22, 1998 (EP) ..... 984091524

(51) Int. Cl.[7] ..... H01R 13/64
(52) U.S. Cl. ..... 439/248
(58) Field of Search ..... 439/248, 247, 439/246, 237, 552, 555, 557

(56) References Cited

U.S. PATENT DOCUMENTS 5,575,673 * 11/1996 Dahlem et al. ..... 439/248
5,980,290 * 11/1999 Meynier et al. ..... 439/246

FOREIGN PATENT DOCUMENTS 39 03 839-C2 8/1989 (DE) .
0 371 835-B1 6/1990 (EP) .

* cited by examiner

*Primary Examiner*—Brian Sircus
*Assistant Examiner*—Chandrika Prasad

(57) ABSTRACT

A connector is floatably mounted to a panel which has a cutout receiving the connector therethrough. In the unmated condition, the mating face of the connector is biased away from the panel by a spring, and widened portions of the connector are received in complementary recesses of the panel cutout. The engagement of the widened portions in the recesses centers the connector with respect to the panel cutout. During coupling with a complementary connector, the first connector is biased in the mating direction such that the widened portions disengage from the complementary recesses thereby allowing floating movement of the first connector with respect to panel, in the plane orthogonal to the mating direction.

9 Claims, 3 Drawing Sheets

FLOATING CONNECTOR ASSEMBLY

BACKGROUND OF THE INVENTION

1. Field of the Invention

This invention relates to an electrical connector assembly comprising a first connector and a second connector matable therewith, the assembly floatably mounted with respect to a device such as a panel to enable adjustment of positional tolerances during coupling.

2. Description of the Prior Art

European Patent 371835, and German Patent DE 3903839, disclose connectors floatably mountable to a panel or support in order to adjust for tolerances in the relative position between connectors to be coupled. In DE 3903839, the connector compensates for angular misalignment in addition to translational misalignment. Adjustment for misalignment is typically required when the connectors are mounted on devices that are assembled together, whereby connector coupling occurs automatically. The devices may be relatively large with respect to the connectors, an example of a potential application being the assembly of automobile body or component parts, such as an automobile chassis to an automobile body or a seat to the bodywork. Assembly of such devices require particularly large absorption of positional tolerances.

In the prior art, it is typical to have a connector with a funnel shaped entry at the mating face for guiding the mating connector. The funnel shaped mating face increases the cross-sectional size of the connector. The larger the required tolerance adjustment, the larger the cross-section. In order to minimise the size of the connector for a given tolerance, it is important to centre the connector on the panel or structure on which it is floatably mounted. In EP 371835 this is achieved by providing elastic foam pads between the connector and panel cutout. Other conventional connectors typically have elastic arms between the connector and panel cutout. A problem with conventional floatable connectors is that the elastic centering means limit floatability of the connector in the direction of coupling and may be damaged after a few mating cycles or otherwise, possible leading to damage of the connector assembly when coupling.

When assembling large devices, mispositioning in the direction of coupling may be quite large. Prior art connector assemblies, such as shown in DE 3903839 do not have the ability to adjust for large tolerances in the mating direction. It would be desirable in certain applications to have large tolerance absorption in the connector mating direction.

SUMMARY OF THE INVENTION

It is an object of this invention to provide a connector assembly that enables adjustment to large positional tolerances in a reliable manner. It would be advantageous to provide a connector assembly that allows large positional adjustment in the direction of coupling of the connectors and in a plane orthogonal thereto, with respect to devices to which connectors of the assembly are mounted. It would be advantageous to provide a connector assembly that is compact, particularly with respect to a cross-section taken perpendicularly to the connector mating direction.

Objects of this invention have been achieved by a connector assembly comprising a first connector for mating with a second connector in a mating direction, each of the connectors mountable to a support structure whereby the first connector is floatably mountable on its support structure such that the first connector is movable in a plane orthogonal to the mating direction, the connectors being provided with complementary guide means for correctly guiding and locating the connectors during mating, wherein the first connector comprises centering members co-cooperable with complementary centering members of the support structure such that the first connector is located in a centre or neutral position (for example the centre of a cavity or cutout of the support structure) when the first and second connectors are unmated, the centering members disengageable from the support structure when the connector is biased in the mating direction during mating of the second connector with the first connector such that the first connector is floatable with respect to the support structure in the orthogonal plane.

The assembly may further comprise a spring member that biases the first connector in the mating direction with respect to the support structure. When the first and second connectors are unmated, the first connector is resiliently biased into the unmated position where the centering members between the first connector and support structure co-operate to center the first connector. The first connector is provided with retention shoulders that engage the support structure to retain the first connector to the support structure in the unmated position. The centering members of the first connector may be provided on or as extensions of opposed faces of the housing of the connector, in the form of enlargened portions with guide tapers that are insertable into complementary cutouts in the support structure in a snug fit. As the connector is biased from the unmated position in the mating direction during coupling of the connectors, the centering members move out of the complementary cutouts and allow floating movement of the connector within the cutout. The first connector is thus accurately centered with respect to the support structure in the unmated position in a robust and reliable manner. In addition, floatability of the connector in the mating direction is also provided.

DETAILED DESCRIPTION OF THE PREFERRED EMBODIMENT

Figure 1:
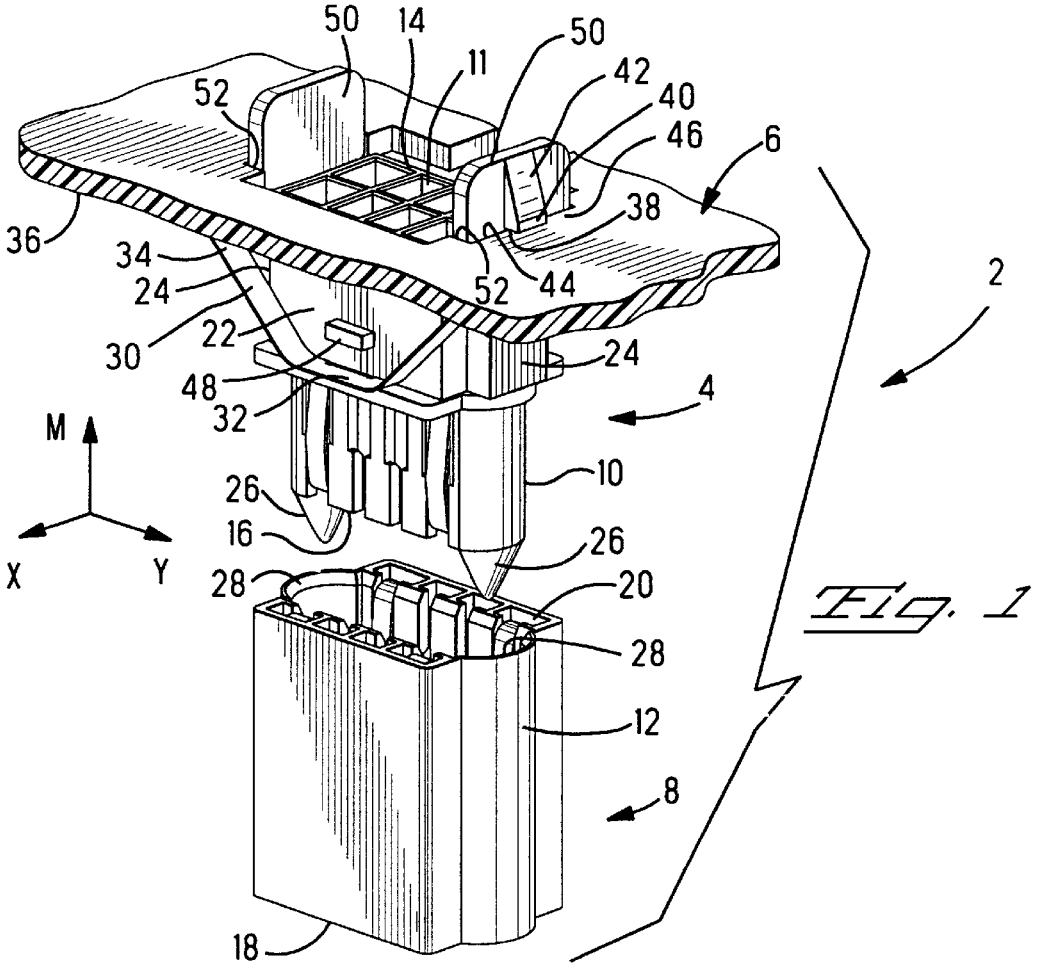
FIG. 1 is a perspective view of a connector assembly according to this invention in the uncoupled state.

Referring to the figures, a connector assembly 2 comprises a first connector 4 mounted on a support structure which in this embodiment is a panel 6, and a second connector 8 matable in a mating direction (M) with the first connector 4. The second connector may also be mounted on a support structure (not shown). The first connector 4 has an insulative housing 10 receiving electrical terminals in cavities 11 for mating with complementary terminals mounted in a housing 12 of the second connector 8. The first connector housing 10 extends in the mating direction from a terminal receiving face 14 to a mating face 16, and similarly the second connector housing extends from a terminal receiving face 18 to a mating face 20. The first connector housing 10 is further bounded by opposed side walls 22 and opposed end walls 24 to form an approximately rectangular connector when considering a cross-section orthogonal to the mating direction (M).

The first connector 4 is provided with mating guide members 26 in the form of tapered or conical projections extending beyond the mating face 16 cooperable with complementary mating guide members 28 of the second connector in order to guide and locate the connectors with respect to each other during mating, thereby absorbing misalignment between the connectors in a plane substantially orthogonal to the mating direction (M). The mating guide members 26 and complementary mating guide members 28 may have various other shapes and constructions found in conventional floating connectors. For example, the guiding may be performed by simply providing a large funnel shaped shroud at the mating end of one of the two connectors for receiving the mating end of the other connector therein. It would also be possible for example to provide the guide members as shown in International Application PCT/IB98/00842.

The assembly 2 further comprises a spring member 30 that is in this embodiment fixed to the first connector housing 10 at a mounting portion 32 and extending therefrom to ends 34 that bias against the mating side 36 of the panel 6. The spring member 30 is for biasing the first connector 4 in the mating direction (M) with respect to the panel 6, such that the mating face 16 of the connector is biased away from the panel. The spring member 30 is in the form of a leaf spring stamped and formed from sheet metal as a single integral part, where a pair of spring arms 33 are provided adjacent opposed sides 22 of the connector, and joined together at their ends 34 by a bridging portion 35. It would also be possible to provide many other constructions such as wire coil springs, or plastic spring members integrally moulded to the housing, as long as a large resilient travel of the connector 4 in the mating direction (M) with respect to the panel 6 is enabled.

In order to retain the connector 4 with respect to the panel 6 in the mating direction (M), the housing is provided with retention shoulders 38 that retain the connector to the panel in the unmated position shown in FIG. 1. In this embodiment the retention shoulders 38 are provided along the end walls 24 but could also be provided on the side walls 22. The retention shoulders 38 are provided on protrusions 40 that have a taper 42 to enable insertion of the connector through a cutout 44 in the panel from the mating side 36 of the panel until latching engagement of the retention shoulder 38 against a complementary edge 46 of the cutout 44. The cutout 44 is profiled to enable the connector to be received through the cutout in the mating direction (M). The connector may be provided with a further stop 48 that delimits resilient biasing of the connector in the mating direction (M) towards the panel 6, by abutment of the stop 48 against panel 6. The latter provides an anti-overstress feature for the spring 30.

Figure 2:
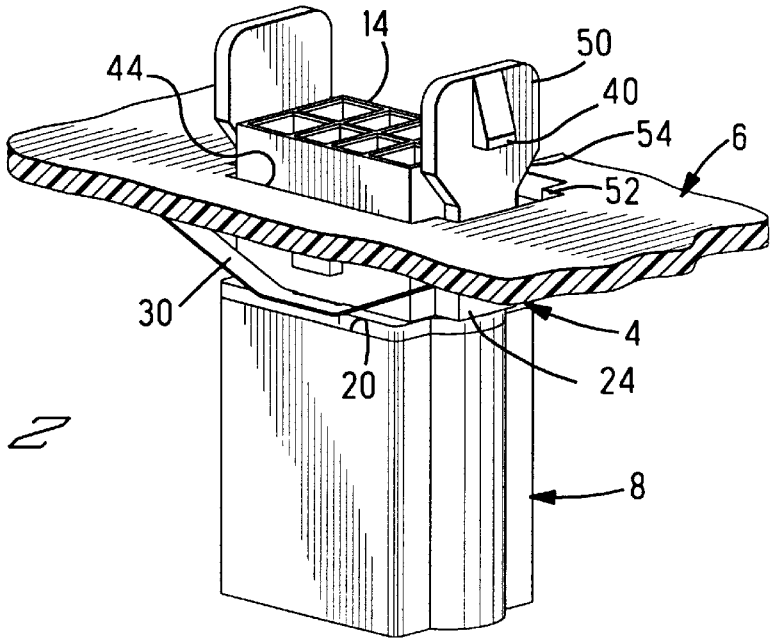
FIG. 2 is a perspective view of the connector assembly in the coupled state.
Figure 3:
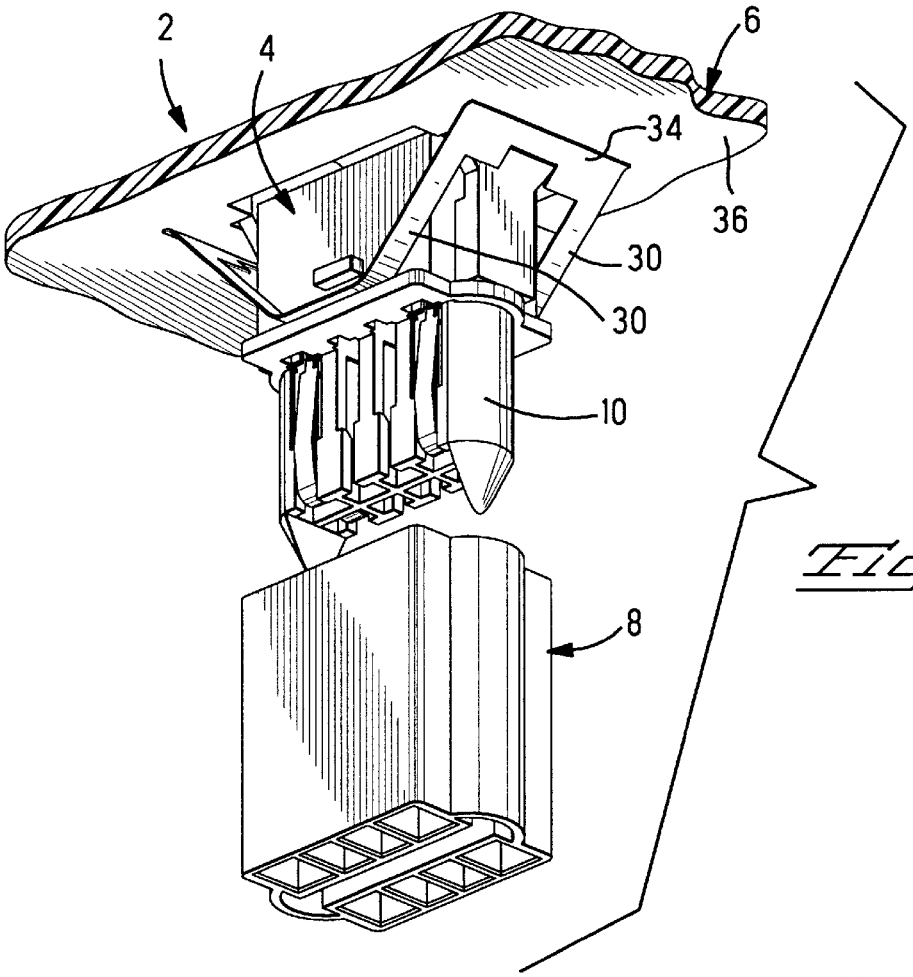
FIG. 3 is a perspective view of the connector assembly during initial coupling, viewed towards the mating side of a panel.
Figure 4:
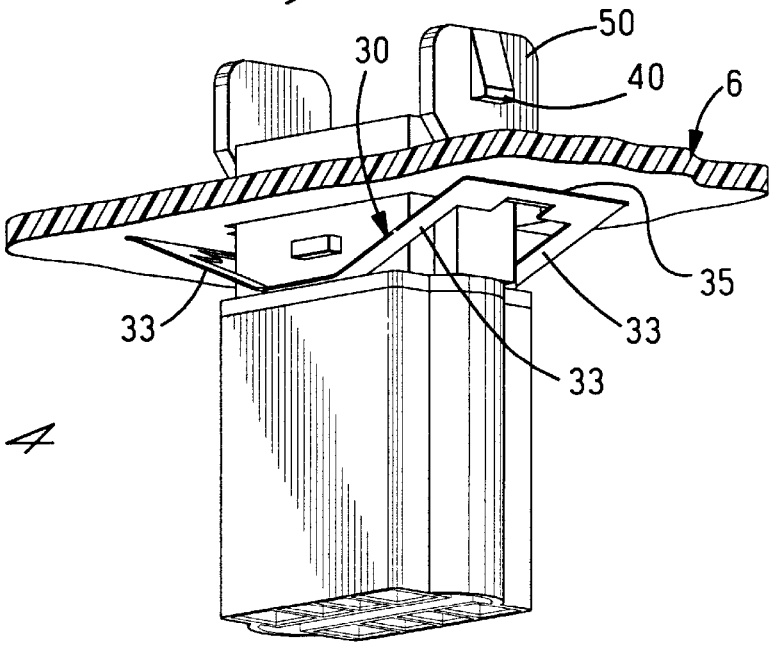
FIG. 4 is a view similar to FIG. 3 of the assembly in the fully coupled state.
Figure 7:
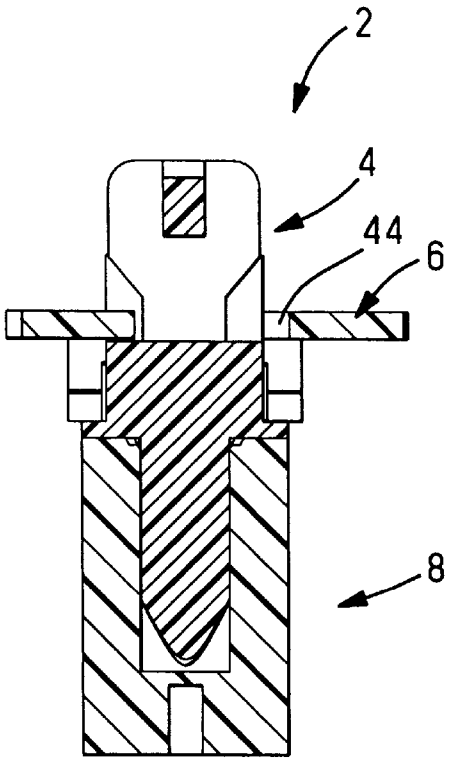
FIG. 7 is a view similar to FIG. 6 showing the connectors in the fully coupled state.
Figure 6:
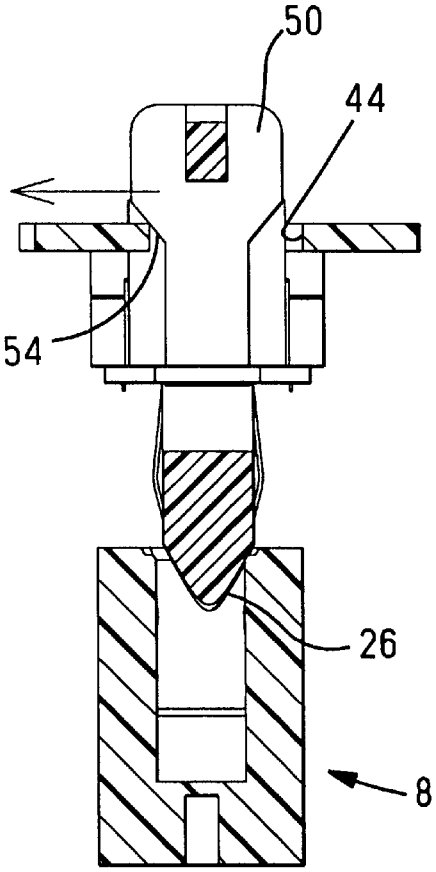
FIG. 6 is a view similar to FIG. 5 showing the connector assembly during initial coupling adjusting for misalignment in the connectors.
Figure 5:
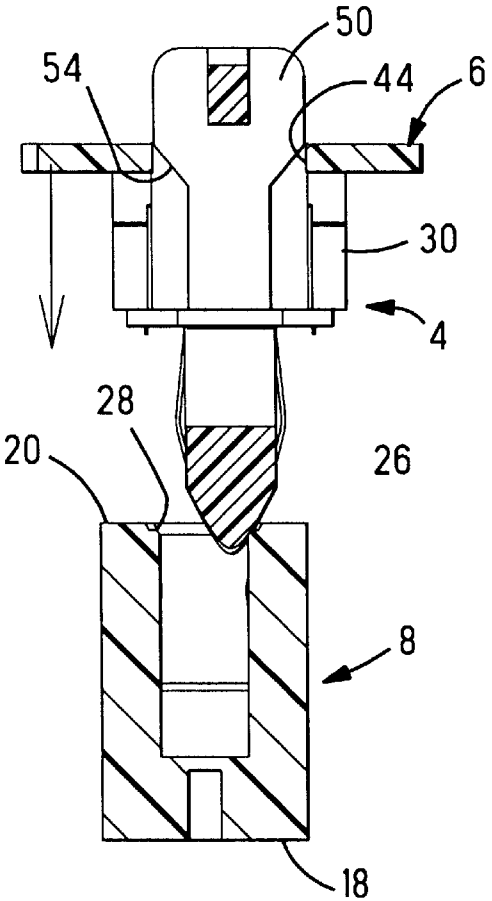
FIG. 5 is a simplified cross-sectional view (without showing the contacts) where the connectors of the assembly are about to be coupled together.

The first connector 4 further comprises centering members 50 that engage in complementary centering members in the form of recesses 52 in the support structure cutout 44. The co-operating centering members 50, 52 ensure that in the unmated position as shown in FIG. 1, where the mating face 16 of the first connector is biased fully away from the panel 6, the connector is in a defined fixed position in a plane orthogonal to the mating direction (M) with respect to the support structure 6. Any mispositioning between the first and second connectors 4, 8 during coupling is thereby kept to a minimum by ensuring that the first connector 4 is always in a defined (center) position prior to engagement of the connectors. The centering members 50, 52 only engage in the fully unmated position shown in FIG. 1, but as the first connector 4 is displaced in the mating direction towards the panel 6, for example during coupling of the connectors 4, 8, then the centering members 50, 52 disengage as shown in FIG. 2 thereby allowing floating movement of the first connector 4 within the panel cutout 44. The panel cutout 44 is dimensioned to allow floating movement of the connector in the plane orthogonal to the mated direction, to the extent required (for example ±5 mm in each of the directions X and Y). In this embodiment, the centering members 50 of the first connector 4 are in the form of enlargened extensions of the side walls 24, and may be provided with tapered surfaces 54 to the side walls for guiding the enlargened portions 50 into the recesses 52 when the connectors are uncoupled and the first connector 4 returns to the fully unmated position shown in FIG. 1.

If the connectors 4, 8 are misaligned during initial coupling, the abutment of the interengaging guide portions 26, 28 will bias the first connector 4 in the mating direction (M) towards the panel 6 thereby disengaging the centering members 50, 52 such that the connector 4 floats relative to the panel thereby enabling alignment and full mating therebetween. In this embodiment the spring 30 is provided with a spring force greater than the required mating force between the connectors to ensure that the connectors 4, 8 are fully mated whilst enabling absorption of tolerances of the assembly with respect to the panel 6 in the mating direction (M). Whilst the centering members 50 are shown as extensions of the side walls 24, and having substantially planar shapes extending beyond the wire receiving face 14 of the connector housing, various other shapes and positions thereof may be given. For example, the centering members may be in the form of substantially semi conical protrusions received in semi circular complementary cutouts of the panel, either on the end walls or on the side walls 22. A multitude of other complementary shapes can be provided.

Whilst in the present embodiment only the first connector 4 is shown mounted to a support structure such as the panel 6 with co-operating centering members 50, 52, the second connector 8 may also be floatably mounted to a support structure with co-operating centering members similar to the first connector.

I claim:

1. A connector assembly comprising a first connector that is mountable to a support structure for mating with a second connector in a mating direction, where the first connector is floatably mountable on the support structure such that the first connector is movable in a plane orthogonal to the mating direction, the connectors being provided with complementary guide members for correctly guiding and locating the connectors during mating, wherein the first connector comprises a centering member engaged with a complementary centering member of the support structure such that the first connector is floatably and resiliently located in a defined position with respect to the support structure when the first and second connectors are unmated, characterized in that the first connector is movably mounted in the mating direction with respect to the support structure and the centering members of the first connector and the support structure are disengaged when the first connector is biased in the mating direction with respect to the support structure during mating of the second connector with the first connector such that the first connector is floatable with respect to the support structure in the plane orthogonal to the mating direction.

2. The connector assembly of claim 1 wherein the first connector is resiliently biased opposite the mating direction towards the fully unmated position by a spring member acting between the support structure and the first connector.

3. The connector assembly according to claim 2 wherein the centering member of the first connector comprises enlargened extensions of opposed side walls of the first connector.

4. The connector assembly according to claim 3 wherein the extensions extend beyond a wire receiving face of the first connector.

5. The connector assembly of claim 4 wherein the extensions include a taper to guide and locate the centering member in a complementary recess of the complementary centering member of the support structure.

6. The connector assembly of claim 4 wherein the spring member is attached to the first connector housing at a mounting portion and extends therefrom to ends that engage against a mating side of the support structure.

7. The connector assembly of claim 6 wherein the spring member is in the form of a leaf spring stamped and formed from sheet metal.

8. The connector assembly of claim 4 wherein the spring member is provided with a spring force greater than the force required to mate the connectors.

9. The connector assembly of claim 2 wherein the first connector housing is provided with two spaced apart retention members that delimit movement of the first connector with respect to the support structure along the mating direction between the fully unmated position where the mating face of the connector is biased fully away from the support structure, to a stop position where the spring member is fully compressed, the distance between the retention protrusions defining a maximum displacement along the mating direction.

* * * * *